US009869174B2

(12) United States Patent
Szpunar et al.

(10) Patent No.: US 9,869,174 B2
(45) Date of Patent: Jan. 16, 2018

(54) SYSTEM AND METHOD FOR MONITORING TOOL ORIENTATION IN A WELL

(71) Applicant: Vetco Gray Inc., Houston, TX (US)

(72) Inventors: Stephen Jude Szpunar, Houston, TX (US); Daniel W. Sexton, Niskayuna, NY (US); Chad Eric Yates, Houston, TX (US); Oladapo Akinyede, Houston, TX (US); Samved Bhatnagar, Houston, TX (US)

(73) Assignee: VETCO GRAY INC., Houston, TX (US)

( * ) Notice: Subject to any disclaimer, the term of this patent is extended or adjusted under 35 U.S.C. 154(b) by 53 days.

(21) Appl. No.: 14/698,516

(22) Filed: Apr. 28, 2015

(65) Prior Publication Data

US 2016/0319657 A1 Nov. 3, 2016

(51) Int. Cl.
*E21B 47/09* (2012.01)

(52) U.S. Cl.
CPC ..... *E21B 47/091* (2013.01)

(58) Field of Classification Search
CPC ..... E21B 47/12
USPC ..... 340/855.4
See application file for complete search history.

(56) References Cited

U.S. PATENT DOCUMENTS 4,206,810 A 6/1980 Blackman
4,862,426 A 8/1989 Cassity et al.
6,317,387 B1 * 11/2001 D'Amaddio ..... G01N 29/11 114/222
7,819,189 B1 10/2010 Cosby
8,416,098 B2 4/2013 Garcia-Osuna et al.
9,091,604 B2 7/2015 Kobata et al.
2001/0013410 A1 * 8/2001 Beck ..... E21B 31/18 166/65.1
2003/0062155 A1 4/2003 Summers
2004/0200613 A1 * 10/2004 Fripp ..... E21B 47/16 166/250.01
2005/0110655 A1 * 5/2005 Layton ..... E21B 43/128 340/854.9

(Continued)

FOREIGN PATENT DOCUMENTS

EP 1212515 B1 9/2010
WO 2009146548 A1 12/2009

(Continued)

OTHER PUBLICATIONS

Allen et al., "Intelligent Running Tool to Provide Real-Time Feedback for Subsea Casing Hanger Landing Operations", Offshore Technology Conference, pp. 1-8, May 2000.

(Continued)

*Primary Examiner* — Nader Bolourchi
(74) *Attorney, Agent, or Firm* — Hogan Lovells US LLP

(57) ABSTRACT

A system for monitoring the orientation and position of components in an oil well. The system includes a first well component, a second well component, and a transducer attached to the first well component, for generating a pulse. The system also includes a transceiver attached to the second well component for measuring the parameters of the pulse generated by the transducer, and a processor in communication with the transceiver that receives information about the parameters of the pulse as measured by the transceiver, and that calculates the position of the transceiver relative to the transducer.

20 Claims, 2 Drawing Sheets

(56) References Cited

U.S. PATENT DOCUMENTS

| | | | | |
|---|---|---|---|---|
| 2006/0028916 | A1 | 2/2006 | McMechan et al. | |
| 2007/0039738 | A1* | 2/2007 | Fenton | E21B 47/09 166/368 |
| 2007/0194947 | A1* | 8/2007 | Huang | E21B 47/14 340/854.3 |
| 2008/0008043 | A1 | 1/2008 | Jong | |
| 2011/0205847 | A1 | 8/2011 | Lemenager | |
| 2012/0275274 | A1 | 11/2012 | Gochnour et al. | |
| 2013/0083627 | A1 | 4/2013 | Yates | |
| 2013/0088362 | A1 | 4/2013 | Yates | |
| 2014/0251603 | A1 | 9/2014 | Raducanu et al. | |
| 2015/0041119 | A1* | 2/2015 | Plotnikov | E21B 33/03 166/250.01 |
| 2015/0377016 | A1 | 12/2015 | Ahmad | |

FOREIGN PATENT DOCUMENTS

| | | | |
|---|---|---|---|
| WO | 2013056859 | A1 | 4/2013 |
| WO | 2014011823 | A1 | 1/2014 |

OTHER PUBLICATIONS

Kuzlu et al., "Design of an Underwater Communication Receiver Pre-Amplifier", Signal Processing and Communications Applications Conference (SIU), 2010 IEEE 18th, pp. 37-40, Apr. 2010.

MacDonald et al., "Latest Developments in Acoustic Subsea Control and Monitoring for the Drilling Industry", Society of Petroleum Engineers, pp. 1-4, Jun. 2011.

Non-Final Office Action issued in connection with related U.S. Appl. No. 15/133,765 dated Sep. 22, 2016.

GB Search Report and Opinion issued in connection with corresponding GB Application No. 1607276.1 dated Nov. 2, 2016.

Sexton., "BOP Acoustic Channel Assesment", GE Global Research, RF and Instrumentation Systems Laboratory.

Chad Eric Yates et al., filed May 1, 2014, U.S. Appl. No. 61/987,300.

Derrell Wade Bird et al., filed Apr. 20, 2015, U.S. Appl. No. 62/149,922.

Derrell Wade Bird et al., filed Apr. 20, 2016, U.S. Appl. No. 15/133,765.

* cited by examiner

SYSTEM AND METHOD FOR MONITORING TOOL ORIENTATION IN A WELL

CROSS-REFERENCE TO RELATED APPLICATIONS

This application claims priority to and the benefit of U.S. Provisional Patent Application Ser. No. 61/987,300, which was filed May 1, 2014, the full disclosure of which is hereby incorporated herein by reference in its entirety.

BACKGROUND OF THE INVENTION

1. Field of Invention

The present disclosure relates in general to oil and gas drilling equipment, and more particularly to a system and method for monitoring the position and orientation of equipment in a wellhead assembly.

2. Description of Related Art

Subsea running tools are typically used to operate equipment within subsea wellheads and subsea production trees. This may include landing and setting of hangers, trees, wear bushings, logging tools, etc. Current running tools are generally hydraulically or mechanically operated, and are often used to assemble a subsea wellhead by landing and setting a casing hanger and associated casing string. A mechanical running tool usually lands and sets the casing hanger within the wellhead by landing on a shoulder and undergoing a series of rotations using the weight of the casing string to engage dogs or seals of the casing hanger with the wellhead. Typical hydraulic running tools land and set the casing hanger by landing the hanger on a shoulder in the wellhead. Drop balls or darts are sometimes used to block off portions of the tool, wherein hydraulic pressure will build up behind the ball or dart causing a function of the tool to operate to engage locking dogs of the hanger or set a seal between the hanger and wellhead. Pressure behind the ball or dart is increased to release the ball or dart for use in subsequent operations. Some tools are a combination of mechanical and hydraulic tools and perform operations using both mechanical functions and hydraulically powered functions. These tools are complex and require complex and expensive mechanisms to operate, and thus are prone to malfunction due to errors in both design and manufacturing. As a result, the tools installation operations may fail at rates higher than desired when used to drill, complete, or produce a subsea well. Failure of the tool installation operation means the tool and installed equipment, e.g., a casing hanger, must be pulled from and rerun into a well, adding several days and millions of dollars to a job.

These tools provide limited feedback to operators located on the rig. For example, limited feedback directed to the torque applied, the tension of the landing string, and the displacement of the tool based on sensors on the surface equipment may be communicated to the rig operator. When a malfunction occurs downhole, however, it is not known until the string is retrieved and the tool is inspected, taking several hours and costing thousands of dollars. Also, even if there is no malfunction, rig operators generally do not have definitive confirmation that the running tool has operated as intended at the subsea location until the running tool is retrieved and inspected. A pressure test can often be passed even if the equipment has not been installed per the specification.

SUMMARY OF THE INVENTION

An example embodiment of the present invention provides a system for monitoring the orientation and position of components in an oil well. The system includes a first well component, a second well component, and a transducer attached to the first well component, for generating a pulse. The system further includes a transceiver attached to the second well component for measuring the parameters of the pulse generated by the transducer, a processor in communication with the transceiver that receives information about the parameters of the pulse as measured by the transceiver, and that calculates the position of the transceiver relative to the transducer.

An alternate embodiment of the present invention provides a system for monitoring the orientation and position of components in an oil well. The system includes a well head member attached to the top of the well, a well head sensor attached to the well head member, a hanger for insertion into the well head member, and a hanger sensor attached to the hanger, the well head sensor and the hanger sensor emitting a signal when positioned a predetermined distance from one another to indicate that the hanger is properly positioned within the well head member. The system further provides a receiver for receiving the signal from, and in communication with, the hanger sensor, the well head sensor, or both the hanger sensor and the well head sensor.

Yet another embodiment of the present invention provides a method of determining the location of a moveable component of a well head assembly having a transceiver attached thereto relative to a stationary component of the well head assembly having a transducer attached thereto. The method includes moving the moveable component of the well head assembly relative to the stationary component of the well head assembly, and emitting a pulse from the transducer. The method also includes receiving the pulse by the transceiver, determining the position of the transceiver relative to the transducer based on the time of flight of the pulse between the transducer and the transceiver, or the strength of the pulse when received by the transceiver, and determining the position of the moveable component of the well head assembly relative to the stationary component of the wellhead assembly based on the position of the transceiver relative to the transducer.

BRIEF DESCRIPTION OF DRAWINGS

Some of the features and benefits of the present invention having been stated, others will become apparent as the description proceeds when taken in conjunction with the accompanying drawings, in which.

Figure 1:
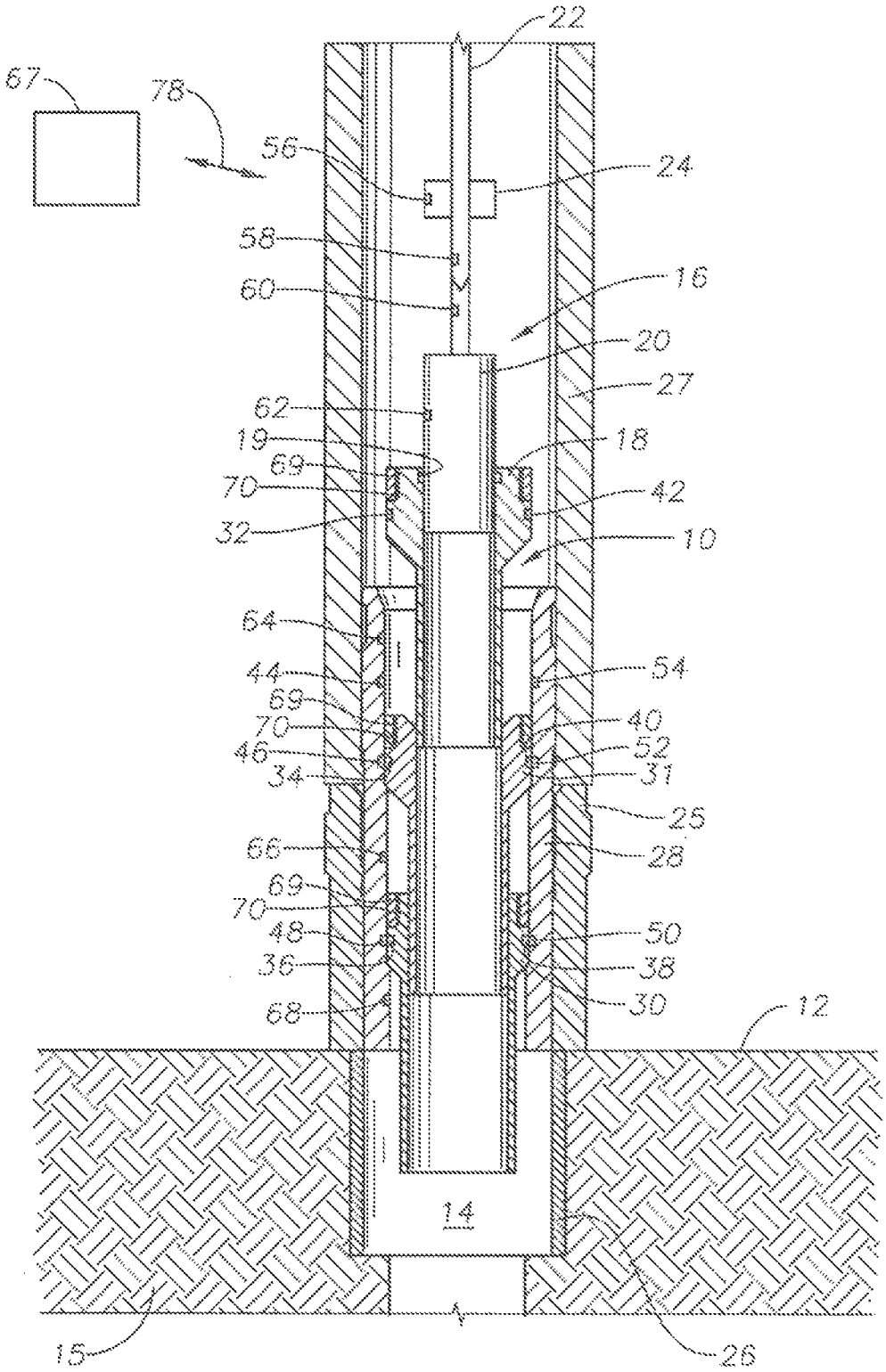
FIG. 1 is a side cross-partial sectional view of a system for monitoring tool orientation in a well, according to an embodiment of the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 shows a side cross-sectional view of a wellhead assembly 10 according to one embodiment of the present invention, being assembled on a surface 12, where the surface can be the seafloor. The wellhead assembly 10 is illustrated over a well 14 that intersects formation 15 below the surface 12. In the example, a running tool assembly 16 is employed for landing a tubing hanger 18 in the wellhead assembly 10. The tubing hanger 18 may typically be attached to a string of tubing lowered into the well. The tubing hanger 18 can be landed in the high pressure wellhead housing, as discussed below, or can alternately be landed in, e.g., a tubing hanger spool or a horizontal tree (not shown). As shown in FIG. 1, the tubing hanger 18 is not fully set in the wellhead assembly 10. The running tool assembly 16 is coupled to the tubing hanger 18 by dogs 19 schematically illustrated projecting radially outward from a running tool 20 (which is part of the running tool assembly 16) and into an inner surface of the annular tubing hanger 18. The running tool typically lands the tubing hanger 18 or other hangers, and sets the annular seal (discussed in greater detail below). Also part of the running tool assembly 16 is a tubular string 22, which couples to the running tool 20 and is used for deploying, operating, and orienting the running tool 20 in the wellhead assembly 10. Further included in the running tool assembly 16 of FIG. 1 is a module 24 shown mounted onto the string 22 and above running tool 20. Module 24 is an annular structure that can surround the drill string 22, and can be attached to the running tool 20 via cables or other means. In some embodiments, the module 24 can be integral to the running tool 20.

The wellhead assembly 10 includes an annular low pressure wellhead housing 25 having a conductor pipe 26 that projects into the formation 15. An annular high pressure wellhead housing 28 surrounds the low pressure wellhead housing 25. A blowout preventer (BOP) 27 is mounted to the high pressure wellhead housing 28, wherein clamps (not shown) may be used for mounting the BOP 27 onto the low pressure wellhead housing 25. Casing hangers 30, 31 are shown landed at axially spaced apart locations within the high pressure wellhead housing 28. Each casing hanger 30, 31 connects to a separate string of casing extending into and cemented in the well. A riser (not shown) extends upward from the BOP 27 to a floating platform.

In some embodiments, hanger sensors 32, 34, 36, 38, 40, and 42 are positioned on the hangers 18, 30, and 31. Specifically, hanger sensors 32, 42 may be positioned on tubing hanger 18; hanger sensors 34, 40 may be positioned on casing hanger 31; and hanger sensors 36, 38 may be positioned on casing hanger 30. Corresponding well head sensors 44, 46, 48, 50, 52, and 54 are positioned on the high pressure well head housing 28. The hanger and well head sensors are situated so that when casing hanger 30 is fully seated (i.e., the seal has been lowered relative to the hanger by the running tool and energized) in the high pressure wellhead housing 28, hanger sensors 36, 38 are adjacent well head sensors 48, 50. Similarly, when casing hanger 31 is fully seated in the high pressure wellhead housing 28, hanger sensors 34, 40 are adjacent wellhead sensors 46, 52, and when tubing hanger 18 is fully seated in the high pressure housing 28, hanger sensors 32, 42 are adjacent well head sensors 44, 54. In some embodiments, the sensors may be battery powered.

Still referring to FIG. 1, there is depicted a receiver 56 for receiving signals from the hanger and well head sensors. The receiver 56 can be located, for example, on the module 24, although it could alternately be disposed on any equipment or module in the stack. If needed, signal repeaters can be added to the system to retransmit signals from the sensors to the receiver 56, thereby assisting in the transmission of the signals between the sensors and the receiver 56. For example, in the embodiment of FIG. 1, there is shown a module stem repeater 58, a tool stem repeater 60, and a tool body repeater 62. In addition, there are shown micro repeaters 64, 66, and 68 on the wellhead. The signals can be transmitted from the sensors to the receiver 56 in any appropriate way, such as, for example, via wires from the repeater at the running tool 20 to the receiver 56, or wirelessly. In embodiments where the sensors communicate with the receiver 56 wirelessly, the communication may be conducted via acoustic waves or pulses.

In practice, as the well head assembly 10 is assembled, the low pressure wellhead housing 25 and high pressure well head housing 28 are secured in position over the well 14 using known methods. Thereafter, the running tool 20 is used to insert the hangers 31, 30, 18 into the high pressure wellhead housing 28. An annular seal 69 may typically be included between portions of the hangers 31, 30, 18 and the high pressure well head housing 28. The annular seal 69 can typically be run with the corresponding hanger and the running tool 20, but in an upper position to enable cement returns to flow upward past the hanger. Thereafter, the running tool 20 lowers and energizes the seal 69. Each hanger can have raised ridges, or wickers 70 on an outer surface thereof. One purpose of the wickers 70 is to engage the annular seal to help create a seal between the hanger 31, 30, 18 and the high pressure well head housing 28. In order to create a proper seal, however, it is necessary that the hangers 31, 30, 18 be axially aligned in the appropriate position relative to the high pressure well head housing 28. This axial alignment is one function of the hanger and well head sensors. Normally, rotational orientation or alignment is not needed for casing hangers or concentric type tubing hangers.

For example, as casing hanger 31 arrives at its designated position in the high pressure well head housing 28, the hanger sensors 36, 38 align with the corresponding well head sensors 48, 50. For hangers where rotational orientation is not carried out, the sensors 36, 38 can be spaced around the circumference of the hanger. As the sensors align, they transmit a signal (e.g., an electromagnetic, acoustic, RFID, or other appropriate type of signal) indicating that appropriate alignment has been achieved. The signal is then received by the receiver 56, and the operator is alerted that the casing hanger 31 is in the proper position. The range of the hanger sensors 36, 38 and well head sensors 48, 50 can be calibrated to any desired sensitivity. For example, in some applications, where it may be desired that the wicker interface length with the annular seal be a predetermined minimum length (e.g., 1 inch), the hanger sensors 36, 38 and well head sensors 48, 50 can be positioned and calibrated so that the signal (indicating that the hanger is fully set) is not transmitted by the sensors until the desired wicker interface length is achieved. The same process applies to the setting of hangers 18 and 30.

In alternative embodiments, any number of sensors may be used on the hanger and the well head housing according to the needs of a particular assembly. In addition, the sensors may be configured in any way along the length of the hanger and the well head housing, or around the circumference thereof. The particular configuration of FIG. 1 is shown by way of example only. In addition, the sensors can be any type of sensor, including, for example, radio frequency identification (RFID) sensors or proximity sensors, such as Hall effect magnetic sensors.

Further shown in FIG. 1 is a controller 67 that communicates with the receiver 56 via a communication means 78. The controller can be located subsea near the wellhead, and can communicate with an operator on the surface in any appropriate way, such as, for example, via an umbilical, wirelessly, such as by acoustic pulse, by displaying information for collection by a remotely operated vehicle, etc. In one embodiment, an output of controller 67 is available to personnel operating the running tool assembly 16, and communication means 78 can be wireless, conductive elements, fiber optics, acoustic, or combinations thereof. In an example of landing tubing hanger 18 within wellhead assembly 10, communication between hanger sensors 32, 42 and well head sensors 44, 54 is monitored at controller 67, and transmitted from receiver 56 to controller 67 by communication means 78. The position of the tubing hanger 18 can be estimated based on signals received from the sensors 32, 42, 44, 54. If no signal is received by receiver 56, this may indicate that tubing hanger 18 is at an incorrect position. Thereafter, the tubing hanger 18 can be repositioned until appropriate signals are received. Although the above description principally describes the sensors as measuring the axial position of the hangers relative to the well head housing 28, other parameters can also be measured, such as azimuthal position, and inclination of the hangers.

Repositioning of the hangers 18, 30, 31 can be performed before cementing by manipulating the running tool assembly 16. Moreover, the step of repositioning can be done based on signals received by the receiver 56, and transmitted to the controller 67. In addition, repositioning can be done iteratively until a signal is received indicating that the casing hanger 30, 31 is positioned as desired.

The embodiment of the present invention shown in FIG. 1 is advantageous over known systems because it helps to ensure that the seal between the hangers and well head housing is sound, and to prevent seal leakage. It accomplishes this by helping to ensure that the components are appropriately aligned when the seal is energized.

Figure 2:
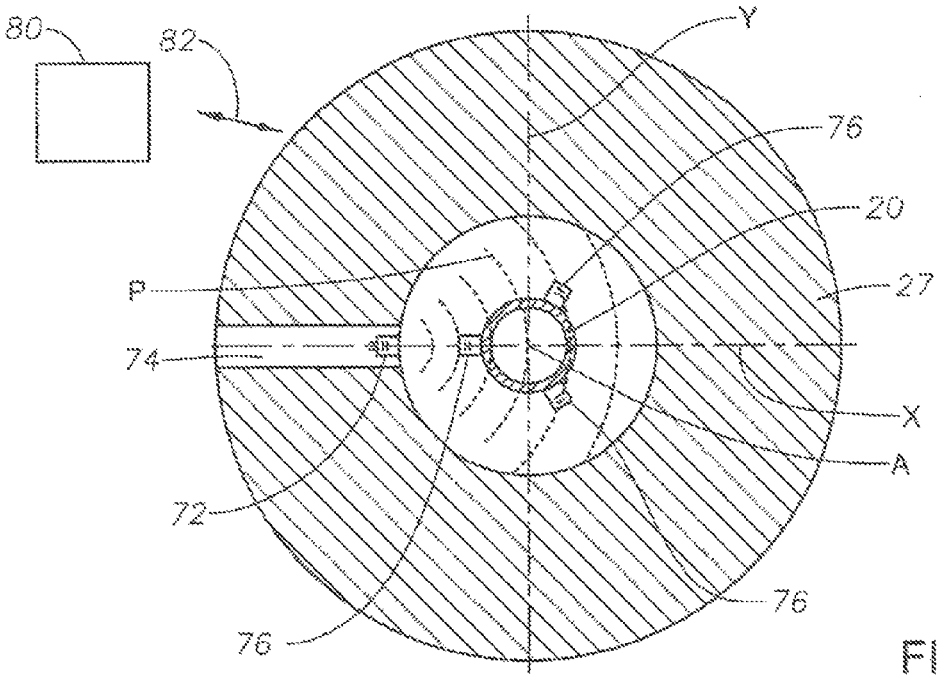
FIG. 2 is an axial cross-sectional view of a system for monitoring tool orientation in a well, according to an alternate embodiment of the present invention.
Figure 3:
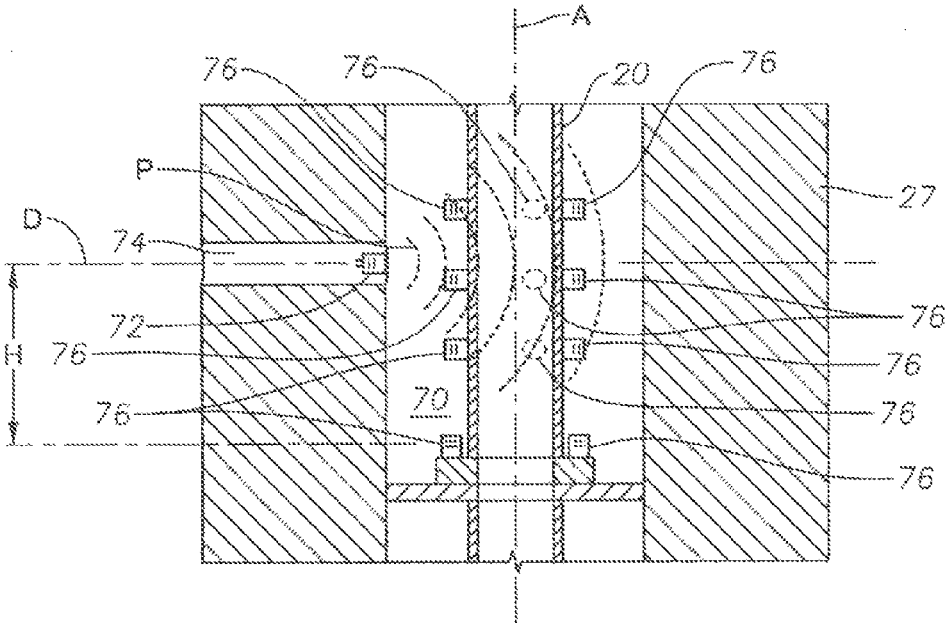
FIG. 3 is a side cross-sectional view of the system for monitoring tool orientation of FIG. 2.

Referring now to FIGS. 2 and 3, there is depicted an alternate embodiment of the present invention, including a transducer 72 (e.g., and acoustic transmitter) installed in a port 74 that extends through a sidewall of the BOP 27, and a plurality of transceivers 76 formed in a transceiver array. The transceivers 76 can be attached to the running tool 20 in any appropriate configuration. The transducer 72 can send a pulse P, such as an electromagnetic or acoustic pulse, generally inwardly toward the axis A of the running tool 20, which pulse P expands as it moves away from the transducer 72. As the pulse P travels away from the transducer 72, it is received by the transceivers 76, which in turn measure parameters of the pulse, such as the time of flight of the pulse P between the transducer 72 and each transceiver 76, and/or the strength of the pulse P. The transceivers 76 can be battery powered. Alternatively, the transceivers 76 can be of a type that do not require power, such as surface acoustic wave (SAW) chips, that instead reflect the pulse P back to the transducer 72.

As particularly shown in FIG. 2, as the pulse P travels, it expands parallel to a plane defined by the X and Y axes. Based upon the strength, direction, and/or time of flight of the pulse P at or to a particular transceiver 76, the position of the transceiver 76 relative to the transducer 72 along the X-Y plane can be determined. Simultaneously, as particularly shown in FIG. 3, the pulse P expands upward and downward relative to a datum plane D, which is positioned at a height in the BOP even with the transducer 72, and which is substantially perpendicular to the axis A of the running tool 20. Based upon the strength, direction, and/or time of flight of the pulse P at a particular transceiver 76, the height H of the transceiver 76 relative to the transducer 72 can be determined as well.

Once the above data about the strength, direction, and/or time of flight of the pulse P is collected by the transceivers 76, the information can be sent to a controller or processor 80, which uses known triangulation techniques to determine the position of each transceiver 76 relative to the transducer 72. The processor 80 can be located subsea near the wellhead, and can communicate with an operator on the surface in any appropriate way, such as, for example, via an umbilical, wirelessly, such as by acoustic pulse, by displaying information for collection by a remotely operated vehicle, etc. Transmission of the data can be achieved by any appropriate transmission means 82, including, for example, wires (not shown) or wireless transmission via radio waves or other means. Thus, using known triangulation techniques, the generation of pulses P from the transducer 72 and subsequent measurement of the strength, direction, and/or time of flight of those pulses P by the transceivers can generate the necessary data to determine the position and orientation of the running tool 20 relative to the BOP 27. The processor can also convey information to the operator about the position of the running tool 20. This can be accomplished, for example, by providing the information on a display screen (not shown).

Although the transducer 72 is shown in FIGS. 2 and 3 to be attached to the BOP 27, in practice the transducer 72 could be attached to any part of the system, such as, for example, a drilling connector, well head housing, or tree body. Similarly, the transceivers could be attached to any equipment lowered into a well, such as, for example, a drill string, or a hanger. In addition, the position of the transducer 72 and transceivers 76 could be reversed, so that the transducer 72 is attached to the running tool 20 or other equipment lowered into the well, and the transceivers 76 are attached to stationary parts of the system, such as the BOP or the well head housing.

The embodiment of the present invention shown in FIGS. 2 and 3 provides certain advantages over other known systems. For example, the ability to accurately determine the position of the running tool 20 or other equipment reduces the number of trips needed to place components in the well. Using the transducers and transceivers described herein, downhole equipment can more easily be located and installed in a single trip as the operator gets real time feedback. Furthermore, installation of the downhole equipment is more accurate, which leads to long term reliability of the equipment.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. Previously known devices are limited to indicating the downhole arrival of the well tool. These devices however are unable to calculate the orientation, alignment, or axial inclination of components in the wellhead assembly, which are features of embodiments herein, and which enables a more precise installation of such components. These and other similar modifications will readily suggest themselves to those skilled in the art, and are intended to be encompassed within the spirit of the present invention disclosed herein and the scope of the appended claims.

What is claimed is:

1. A system for monitoring the orientation and position of components in an oil well, the system comprising:

a first well component;

a second well component movable relative to the first well component;

a transducer attached to the first well component, for generating a pulse;

a transceiver attached to the second well component for measuring parameters of the pulse generated by the transducer, the parameters corresponding to a distance between the first well component and the second well component; and a processor in communication with the transceiver that receives information about the parameters of the pulse as measured by the transceiver, calculates the position of the transceiver relative to the transducer, and determines a position of the second well component relative to the first well component based on the parameters of the pulse.

2. The system of claim 1, wherein the first well component is a stationary well component and the second well component is a moveable well component.

3. The system of claim 1, wherein the first well component is a moveable well component and the second well component is a stationary well component.

4. The system of claim 1, further comprising:

a plurality of transceivers positioned in discrete locations on the second well component, each receiver for measuring the parameters of the pulse generated by the transducer.

5. The system of claim 4, wherein the processor calculates the position of each of the plurality of transceivers relative to the transducer, and then uses the calculated position to determine the position of the second well component relative to the first well component or vice versa.

6. A system for monitoring the orientation and position of components in an oil well, the system comprising:

a well head member attached to the top of the well;

a well head sensor attached to the well head member;

a hanger for insertion into the well head;

a hanger sensor attached to the hanger, at least one of the well head sensor and the hanger sensor having a sensitivity calibrated to detect presence of the other within a predetermined range and emitting at least one signal when the well head sensor and the hanger sensor are within the predetermined range of one another to indicate that the hanger is properly positioned within the well head member; and a receiver for receiving the at least one signal from, and in communication with, the hanger sensor, the well head sensor, or both the hanger sensor and the well head sensor.

7. The system of claim 6, further comprising:

a controller in communication with the receiver for conveying data about the sensors from the receiver to an operator.

8. The system of claim 6, further comprising:

a repeater attached to the well head member to retransmit the at least one signal from the sensor to the receiver.

9. The system of claim 6, wherein the components of the oil well comprise:

a running tool assembly for setting the hanger in the well head member, wherein a repeater is attached to the running tool assembly to retransmit the at least one signal from the sensors to the receiver.

10. The system of claim 6, further comprising:

an annular seal between the hanger and the well head member;

wherein an outer diameter of a portion of the hanger has ridges to help seal an interface between the hanger and the annular seal when the hanger is set in the well head member.

11. The system of claim 10, wherein the hanger is fully set in the well head member when a predetermined length of the ridges of the hanger engage the annular seal, and the well head sensor and hanger sensor are calibrated to emit the at least one signal when the predetermined length of the ridges engage the annular seal.

12. The system of claim 11, wherein the predetermined length is one inch.

13. A method of determining well component location, the method comprising:

a) moving a moveable component of the well head assembly relative to a stationary component of the well head assembly, the moveable component having a transceiver attached thereto and the stationary component having a transducer attached thereto;

b) emitting a pulse from the transducer;

c) receiving the pulse by the transceiver;

d) determining the position of the transceiver relative to the transducer based on the time of flight of the pulse between the transducer and the transceiver, or the strength of the pulse when received by the transceiver; and d) determining the position of the moveable component of the well head assembly relative to the stationary component of the wellhead assembly based on the position of the transceiver relative to the transducer.

14. The method of claim 13, further comprising:

receiving the pulse by a plurality of transceivers;

determining the position of each of the plurality of transceivers relative to the transducer based on the time of flight of the pulse between the transducer and each of the plurality of transceivers, or the strength of the pulse when received by each of the plurality of transceivers; and determining the position of the moveable component of the well head assembly relative to the stationary component of the wellhead assembly based on the positions of the plurality of transceivers relative to the transducer.

15. The method of claim 13, wherein the transducer comprises an acoustic transmitter.

16. The method of claim 13, wherein the moveable component is a hanger.

17. The method of claim 13, wherein the moveable component is a running tool.

18. The method of claim 1, wherein the second well component is a running tool.

19. The system of claim 1, wherein the parameters comprise a strength, time delay, or both, of the pulse.

20. The system of claim 6, wherein the well head sensor and the hanger sensor emit at least one signal when aligned with each other.

* * * * *